United States Patent [19]

Gersch et al.

[11] 4,123,994

[45] Nov. 7, 1978

[54] APPARATUS FOR SUSPENSION OF A TUBE WALL

[75] Inventors: Karl H. Gersch, Ratingen; Georg Lösel, Uttenreuth, both of Fed. Rep. of Germany

[73] Assignee: Balcke-Dürr Aktiengesellschaft, Ratingen, Fed. Rep. of Germany

[21] Appl. No.: 794,827

[22] Filed: May 9, 1977

[30] Foreign Application Priority Data

May 13, 1976 [DE] Fed. Rep. of Germany ..... 2621189

[51] Int. Cl.[2] ..... F22B 37/24

[52] U.S. Cl. ..... 122/6 A; 122/510

[58] Field of Search ..... 122/6 A, 235 A, 510

[56] References Cited

U.S. PATENT DOCUMENTS 3,295,504 1/1967 Engler ..... 122/510

3,744,458 7/1973 Bruckner et al. ..... 122/235 A

*Primary Examiner*—Kenneth W. Spraque

*Attorney, Agent, or Firm*—Martin A. Farber

[57] ABSTRACT

An apparatus for suspension of a tube wall, particularly a combustion chamber wall, made for example of helical finned tubes which are welded gas-tight with one another extending horizontally or inclined, on an upper part of a steam generator made of vertical tubes, by means of vertically extending tie rods which are connected with the tube wall over welding bridges. Respectively pairs of tie rods which extend spaced by a small distance from one another are secured on the upper part of the steam generator by means of a common connection piece and are welded on their adjacent longitudinal edges over common welding bridges with the tube wall. The welding bridges are spaced from one another in the longitudinal direction of the tie rods.

4 Claims, 4 Drawing Figures

APPARATUS FOR SUSPENSION OF A TUBE WALL

Figure 1:
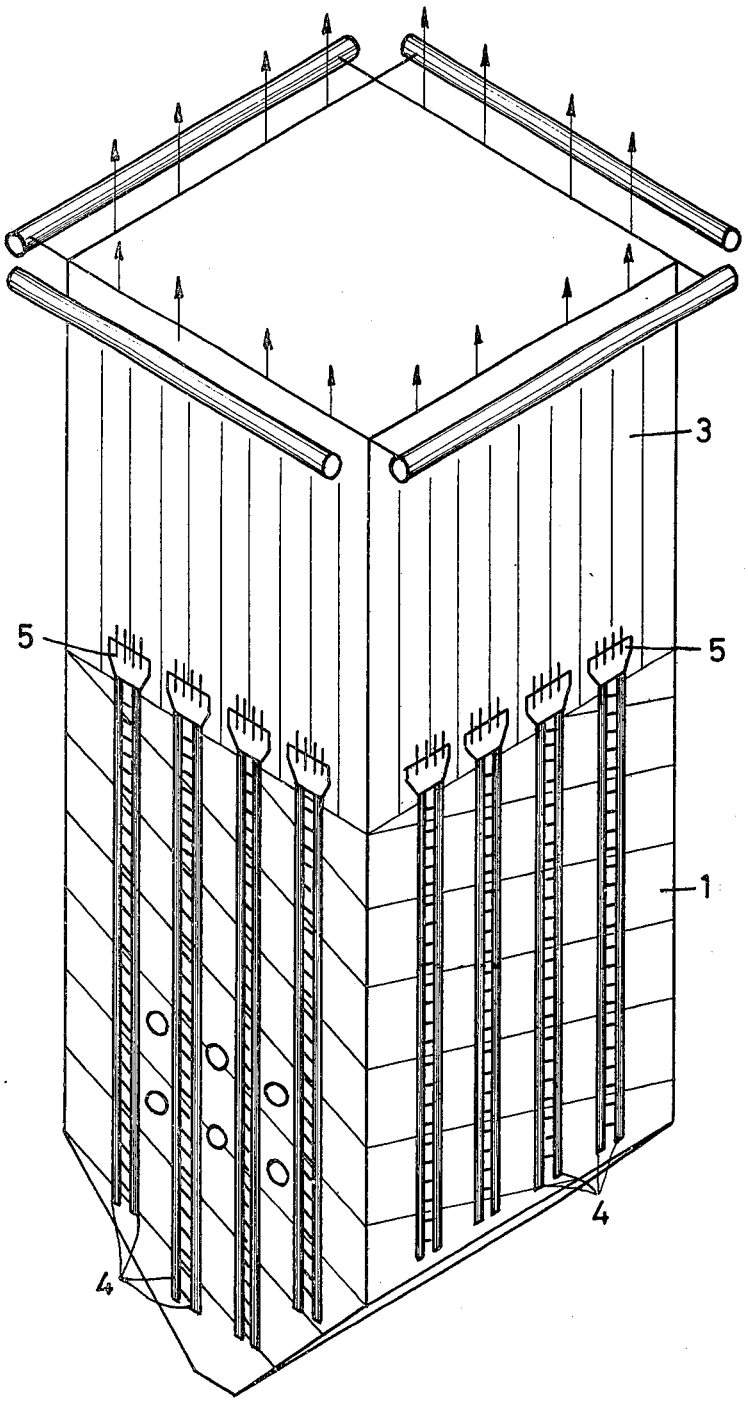

The invention relates to an apparatus for suspension of a tube wall, particularly combustion chamber wall, which tube wall is made of fin-tubes welded gas-tight with one another, extending horizontally or inclined, for example helically-shaped wound finned tubes, on a steam generator which is made of vertical tubes by means of vertically extending tie rods which are connected with the tube wall over welding bridges.

With the known steam generators which are altogether suspended on a supporting framework, the combustion chamber generally consists of a tube wall which is wound helically-shaped from finned tubes welded gas-tight with one another, so that each individual tube extends horizontally to inclined, i.e. at an angle relative to the vertical. Although by the welding of the finned tubes with one another there arises a closed tube wall which is in the position to assume forces in the wall plane, with larger steam generators it is necessary to provide additional suspensions for the combustion chamber, since the upper tubes of the combustion chamber are not expanded from the loading originating from the dead weight and possible additional loads as a consequence of the distribution of load lying transversely to the tube longitudinal axis.

With larger steam generators consequently it is known to connect the combustion chamber over loosely arranged profile irons or rolled sections with the upper vertical tubing of the steam boiler. In order to be able to assume the differential movements occuring between the tube wall and suspension as a result of the temperature difference during the starting up and shutting down of the steam generator, it is necessary in this manner to provide so-called constant hangers or suspensions which equalize the necessarily occuring movement difference. These equalizing elements require a certain space requirement and because of their costly construction are very expensive so that constructively simpler suspensions are sought after.

For this purpose a suspension was developed by which the combustion chamber was suspended on the upper part of the steam generator, the latter being made of vertical tubes, by means of vertically extending tie rods which are connected several times with the combustion chamber — tube wall over welding bridges. The welding bridges are arranged pairwise on approximately opposite positions of the tie bands and respectively are welded on the one hand with the longitudinal edge of the tie rod and on the other hand with the fins of the tube wall.

The previously described embodiment provides a constructively simple suspension for combustion chamber walls on a steam generator upper parts, however possesses the disadvantage that the particularly with larger combustion chamber dimensions and as a consequence of stronger or bigger dimensioning of the tie bands, thermal stresses occur in the longitudinal direction of the tubes which are no longer controlable during the starting up and shutting down of the steam generator. These result from the differential expansion of the tube wall and of the tie rods which are connected with the latter over the welding bridges so that a reliable securing of the tie rods on the tube wall is not possible.

The invention is based on the task to make an apparatus for suspension of a tube wall of the introductory described type on an upper part of a steam generator by means of vertically extending tie rods which are connected with the tube wall over welding bridges, which is kept free of impermissable thermal stresses occuring particularly during the starting up and shutting down, in spite of relatively larger cross-sectional dimensions of the tie rods and also is usable without problem with steam generators with large dimensions in a comparatively small number.

This object is solved in accordance with the present invention in the manner that respectively two tie rods which extend with small distance from one another are secured by means of a common connection piece to the upper part of the steam generator and on their adjacent longitudinal edges are welded with the tube wall over common welding bridges, the latter lying spaced from one another in the longitudinal direction of the tie rods.

By the use of welding bridges which lie above one another respectively spaced from one another, that is in the vertical direction and are respectively welded on two tie rods, the latter extending spaced slightly from one another, the connection of tube wall and tie rod is kept free of thermal stresses in the longitudinal direction of the tubes, since each tie rod is connected only on one longitudinal edge with welding bridges which lie above one another, so that the tube wall in tube longitudinal direction and the tie rods in direction of their width can expand independent from one another. The suspension in accordance with the present invention thus is also usable with larger dimensions of the tie rods of a steam generator.

According to a further feature of the invention, each welding bridge at both sides of a tube is welded on its fins and bridges the tube by means of a recess. In this manner it is possible to connect each second tube of the tube wall with the two tie rods by means of one welding bridge.

Figure 2:
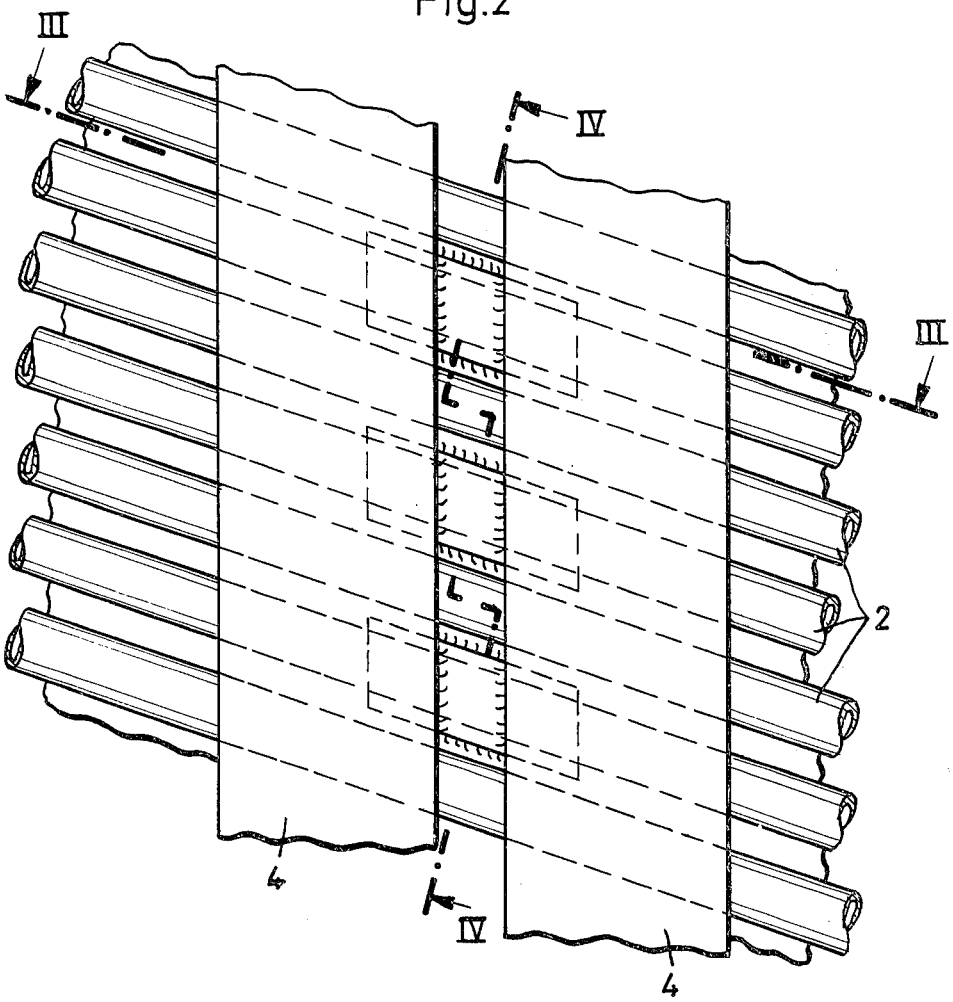
Figure 3:
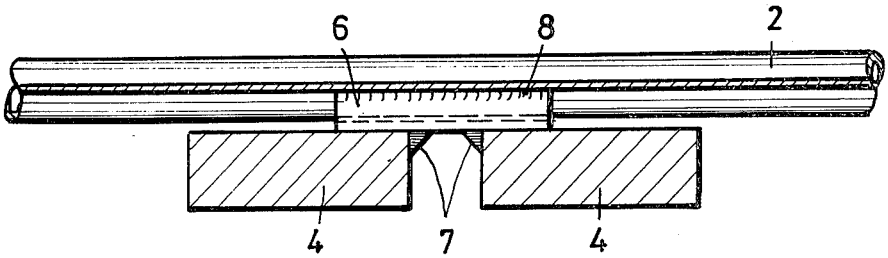
Figure 4:
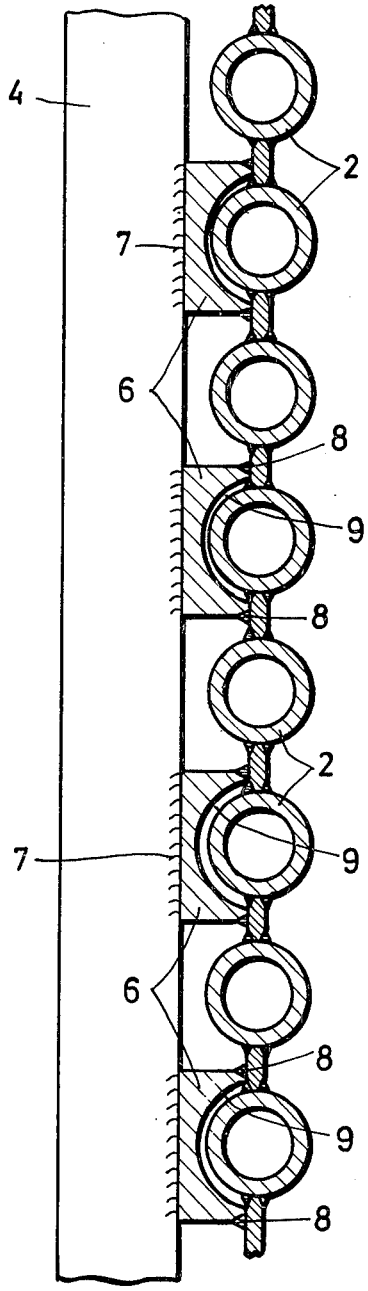

An embodiment example of the suspension device in accordance with the present invention is illustrated on the drawing, and indeed shows:

FIG. 1 a perspective schematic view of a steam generator,

FIG. 2 an enlarged partial view of the connection between tie rods and combustion chamber wall, FIG. 3 a horizontal section according to the section line III—III in FIG. 2 and FIG. 4 a vertical section according to the section line IV—IV according to FIG. 2.

The steam generator schematically illustrated in FIG. 1 has a combustion chamber 1, which is made of helically-formed wound finned tubes 2 which are welded gas-tight with one another and is suspended on the upper part 3 of the steam generator. The suspension takes place by means of tie rods 4, which are arranged in pairs and are connected with their upper ends via connection pieces 5 with the vertically extending tubes of the upper part 3 of the steam generator.

The tie rods 4 respectively are arranged in pairs with small spacing from one another. On their adjacent longitudinal edges, the tie rods 4 are welded onto welding bridges 6, each of which is welded with both tie rods 4 and which bridges are arranged spaced from one another, that is in the vertical direction one above the other, as this may be particularly recognized in the FIGS. 2 and 4.

By the welding of each tie rod 4 by means only of one welding seam 7 with the welding bridges 6 which lie one above the other, the tie rods 4 can expand in the width independent of the longitudinal expansion of the finned tubes 2 of the combustion chamber 1, so that in this direction no thermal stresses are introduced into the tie rods, particularly when during start up and shut down of the steam generator, the tie rods have another temperature than the finned tubes 2 of the combustion chamber 1.

The welding bridges 6 are formed bridge-like in cross-section, as best recognized in FIG. 4. They are welded by means of welding seams 8 with the fins of the finned tubes 2, and bridge the fin-tube 2 which extends between the welding seams 8 by means of a recess 9.

Of course also other tube walls can be suspended as the one combustion chamber in the previously described manner. Moreover it is possible to form the welding bridges differently and for example under circumstances to weld the welding bridges only with one fin extending between two finned tubes.

We claim:

1. An apparatus for suspension of a tube wall, particularly a combustion chamber wall, comprising for example helically-shaped wound finned tubes which are welded gas-tight with one another extending horizontally or inclined, on an upper part of a steam generator which is made of vertical tubes, by means of vertically extending tie rods which are connected with the tube wall over welding bridges, comprising a plurality of tie rods arranged respectively in pairs each comprising two tie rods extending at small distance from one another defining a gap therebetween and a rear face, a common connection piece means for securing said two tie rods of one of said pairs on the upper part of the steam generator, a plurality of common welding bridge means disposed spaced from one another in the longitudinal direction of the tie rods for being longitudinally welded to said two tie rods only on adjacent longitudinal ends, respectively, of said two tie rods adjacent said gap and for being welded to the tube wall only at two upper and lower end points at the fins substantially perpendicularly relative to the longitudinal welding to the two tie rods whereby longitudinal expansion of the tubes and lateral expansion of the tie rods are not restrained.

2. The apparatus according to claim 1, wherein each of said welding bridge means is welded to both sides of a finned tube on the fins thereof, and each of said welding bridge means is spaced from and formed with a recess which bridges over the tube.

3. The apparatus according to claim 1, wherein the other longitudinal ends of said tie rods are completely unconnected and free.

4. An apparatus for suspension of a tube wall, particularly a combustion chamber wall, comprising for example helically wound finned tubes which are welded gas-tightly with one another extending horizontally or inclined, on an upper part of a steam generator, by means of vertically extending tie rods which are connected with the tube wall over welding bridges, comprising a tube wall formed of a plurality of finned tubes having fins on opposite sides of each of said tubes integrally connected to adjacent of said fins of adjacent of said finned tubes, a plurality of tie rods arranged respectively in pairs, each pair comprising two tie rods extending at a small distance from one another forming a spacing therebetween, and having two adjacent longitudinal end portions and two remote longitudinal end portions, respectively, a common connection piece means for securing said two tie rods on the upper part of the steam generator, a plurality of common welding bridges disposed spaced from one another in the longitudinal direction of the tie rods and positioned between said tube wall and said two tie rods behind said spacing leaving the latter free, each of said welding bridges having a first surface welded to said two tie rods only at said two adjacent longitudinal end portions of said two tie rods, respectively, said two remote longitudinal end portions of said two tie rods being completely unconnected and free, and each of said welding bridges having a second surface connected to said tube wall, each of said welding bridges is welded at said second surface only at end portions thereof to both sides of one of said finned tubes on said fins thereof, respectively, and adjacent of said welding bridges being welded to opposite of said fins, respectively, of each of said finned tubes, respectively.

* * * * *